US006176758B1

(12) United States Patent
Wu

(10) Patent No.: US 6,176,758 B1
(45) Date of Patent: Jan. 23, 2001

(54) INFLATABLE BAG

(76) Inventor: Teng-Hui Wu, No. 46-2, Lane 42, Chung Nan St., Taipei (TW)

( * ) Notice: Under 35 U.S.C. 154(b), the term of this patent shall be extended for 0 days.

(21) Appl. No.: 09/305,298

(22) Filed: May 5, 1999

(51) Int. Cl.[7] ..... A63H 3/06
(52) U.S. Cl. ..... 446/224; 446/220
(58) Field of Search ..... 446/202, 220, 446/222, 223, 224, 226

(56) References Cited

U.S. PATENT DOCUMENTS 4,798,554 * 1/1989 Nelson et al. ..... 446/222
4,983,138 * 1/1991 McGrath ..... 446/224
5,188,558 * 2/1993 Barton et al. ..... 446/224
5,334,072 * 8/1994 Epstein ..... 446/224
5,482,492 * 1/1996 Backer ..... 446/224
5,944,576 * 8/1999 Nelson et al. ..... 446/220

* cited by examiner

*Primary Examiner*—Jacob K. Ackun
*Assistant Examiner*—Jeffrey D. Carlson
(74) *Attorney, Agent, or Firm*—Bacon & Thomas, PLLC

(57) ABSTRACT

An inflatable bag includes a collapsible air-tight bag body and a collapsible air inlet device sealed to the collapsible air-tight bag body. The collapsible air inlet device being a flat tube formed of two rectangular flaps sealed together and having an inside wall coated with a layer of ink. And a blow pipe has an inner end inserted into the ink-coated inside wall inside the air inlet device and peripherally sealed to the collapsible air inlet device and an outer end extended out of the collapsible air-tight bag. Forced air is blown through the blow pipe into the air inlet device stretches open the air inlet device and inflates the air-tight bag body, and the air inlet device is compressed by air pressure to close its ink-coated inside wall to stop air from escaping out of the air-tight bag body after the air-tight bag body has been inflated.

1 Claim, 4 Drawing Sheets

INFLATABLE BAG

BACKGROUND OF THE INVENTION

The present invention relates to an inflatable bag, and more particularly to such an inflatable bag which has a collapsible air inlet device, which is compressed by the pressure of the inside air inside the inflatable bag to close the air passage automatically after the inflatable bag has been inflated, and a blow pipe fastened to the collapsible air inlet device through which air is blown through the air inlet device into the inside of the inflatable bag.

FIG. 4 shows an inflatable bag 4 having an air inlet device 41 fastened to a narrow, elongated neck thereof on the inside by a heat sealing apparatus. When inflating the inflatable bag 4, the nozzle tube of an air cylinder is inserted into the air inlet device 41, and then compressed air is released from the air cylinder into the inflatable bag 4, causing the inflatable bag 4 to be inflated. After the inflatable bag 4 has been inflated, the elongated neck 41 is fastened to a support member 6 at one end of a stick 5 to close the air passage of the air inlet device. The procedure of fastening the elongated neck 41 of the inflatable bag 4 to the support member 6 is complicated. Further, because the end of the elongated neck 41 is disposed outside the support member 6, it destroys the sense of beauty of the inflatable bag 4.

SUMMARY OF THE INVENTION

The present invention provides an inflatable bag which eliminates the aforesaid drawbacks. It is one object of the present invention to provide an inflatable bag which automatically closes the air passage to prevent inside air from escaping out of the bag when inflated. It is another object of the present invention to provide an inflatable bag which causes a sense of beauty when inflated. To achieve these and other objects of the present invention, there is provided an inflatable bag comprised of collapsible air-tight bag body, a collapsible air inlet device sealed to the collapsible air-tight bag body, the collapsible air inlet device being a flat tube formed of two rectangular flaps sealed together and having an inside wall coated with a layer of ink, and a blow pipe having an inner end inserted into the ink-coated inside wall inside the air inlet device and peripherally sealed to the collapsible air inlet device and an outer end extended out of the collapsible air-tight bag. Through the blow pipe, air can be driven into the air inlet device by mouth to stretch open the air inlet device and to inflate the air-tight bag body. When the air-tight bag body is inflated, the air inlet device is compressed by air pressure to close its ink-coated inside wall and to stop air from escaping out of the air-tight bag body.

DETAILED DESCRIPTION OF THE PREFERRED EMBODIMENT

Figure 1:
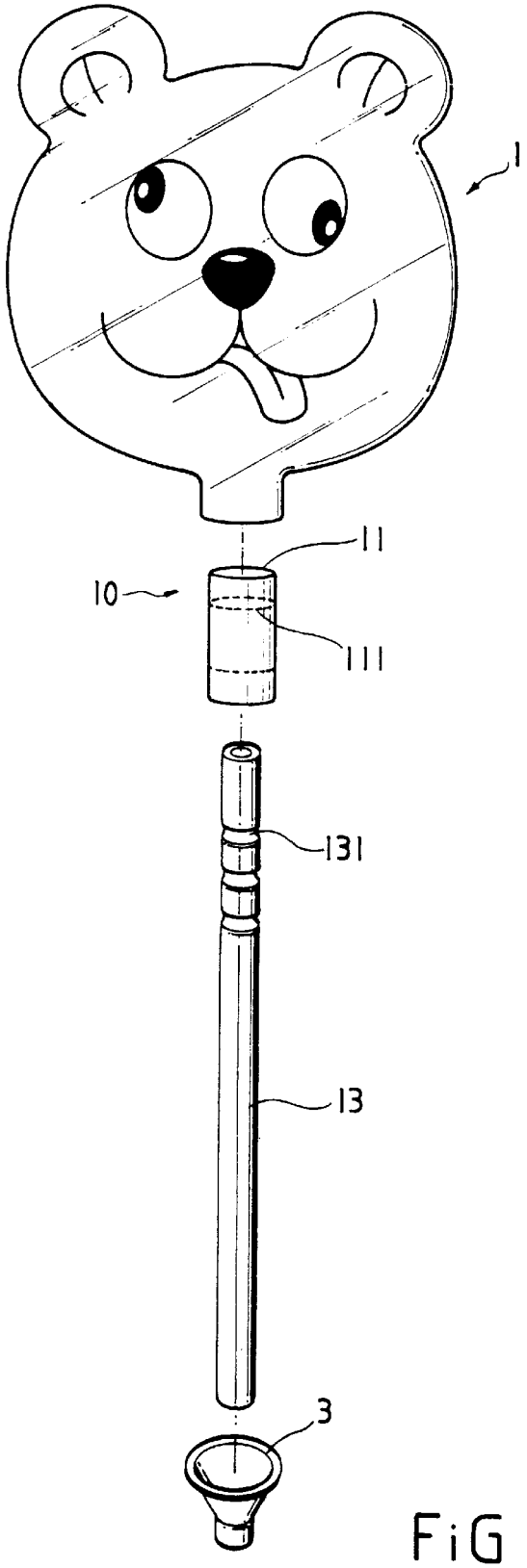
FIG. 1 is an exploded view of an inflatable bag according to the present invention.
Figure 2:
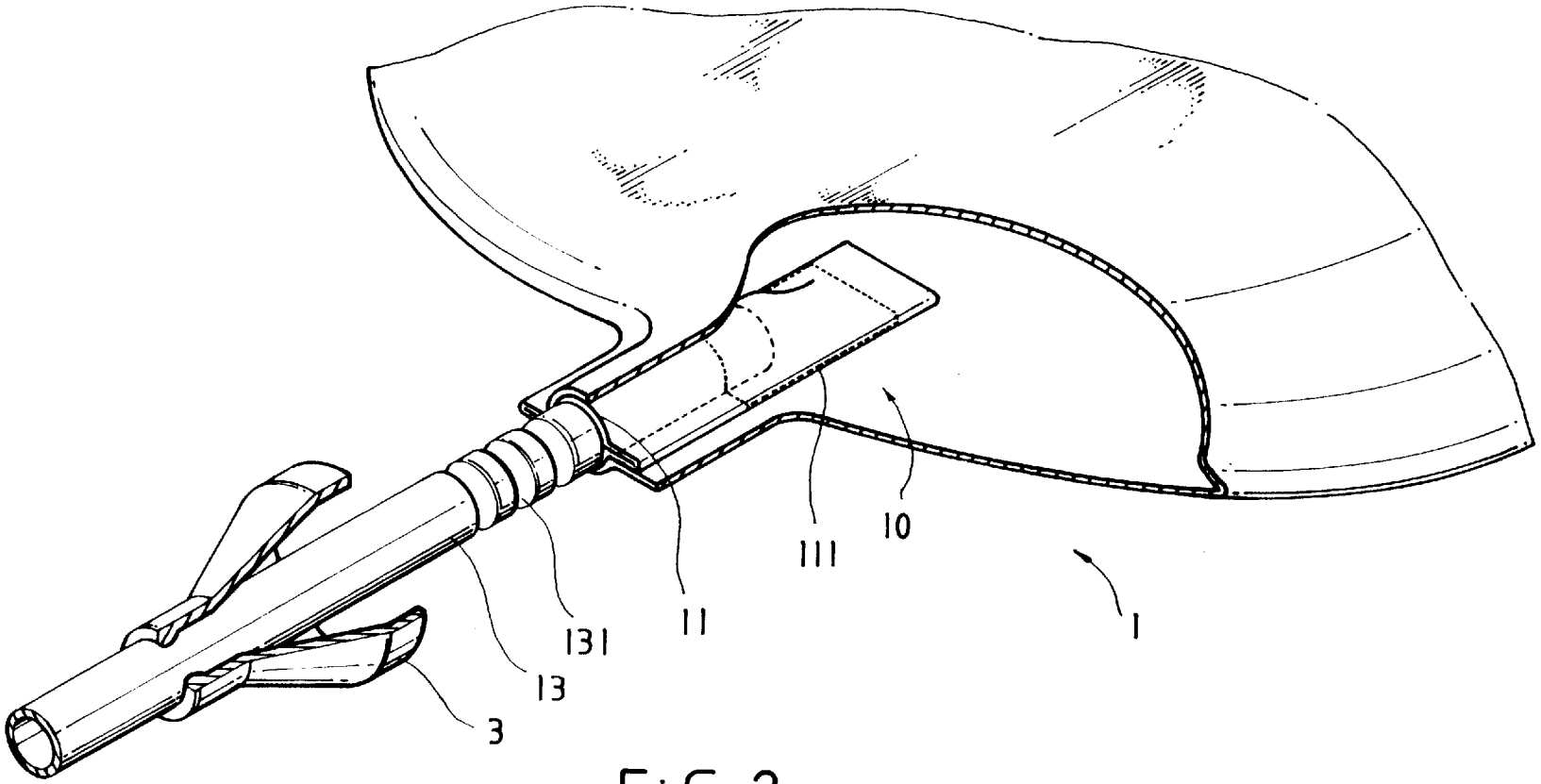
FIG. 2 is a cutaway view in an enlarged scale of the inflatable bag according to the present invention.

Referring to FIGS. 1 and 2, an inflatable bag in accordance with the present invention is generally comprised of a collapsible air-tight bag body 1 which can have any of a variety of shapes, for example, the shape of a cartoon figure, and a collapsible air inlet device 10 sealed to the air-tight bag body 1 on the inside and partially extended to the outside of the air-tight bag body 1. The air inlet device 10 is formed from two rectangular flaps 11 attached together along their opposed longitudinal edges to form a tubular structure, as shown in FIG. 1. The rectangular flaps 11 each have two opposite long sides respectively sealed together with the inside wall of the air-tight bag body 1 by a heat sealing apparatus. When sealed together, the rectangular flaps 11 form a flat tube having an air passage axially extended through its two opposite ends. The rectangular flaps 11 each have a middle part of a respective inside wall coated with a layer of ink, so that an ink coated inside wall area 111 is formed inside the air inlet device 10 on the middle thereof and between its opposite ends. The ink coating prevents portions forming the inside wall area 111 from being sealed together, thereby ensuring that air may freely pass through device 10.

A blow pipe 13 is inserted in to the air inlet device 10. The blow pipe 13 has an inner end retained to the inside of the air inlet device 10 within the ink coated inside wall area 111, and an outer end extended out of the air-tight bag body 11 at a distance. After installation of the blow pipe 13 in the air inlet device 10, the inner end of the blow pipe 13 is peripherally sealed to the air inlet device 10 by a heat sealing apparatus, keeping the both ends of the blow pipe 13 opened. Through the blow pipe 13, air can be blown into the air-tight bag body 1 with the mouth or a gas cylinder. When air is driven into the blow pipe 13, the air inlet device 10 is opened by air pressure, enabling forced air to pass to the inside of the air-tight bag body 1. When the air-tight bag body 1 is inflated, the ink coated inside wall area 111 of the air inlet device 10 is compressed by the air pressure inside the air-tight bag body 1 to seal the air passage of the air inlet device 10, and therefore inside air is stopped from escaping out of the air-tight bag body 1. Further, locating means, for example, annular grooves 131 are provided around the periphery of the blow pipe 13 outside the air-tight bag body 1 adjacent the air inlet device 10 for engaging and positioning a support member 3 to support the inflated air-tight bag body 1 on the blow pipe 13. The means can be variously embodied. For example, it can be in the form of a flange formed integral with the peripheral of the blow pipe 13 and having a width that gradually increases toward the air inlet device 10 for engagement by support member 3.

Figure 3:
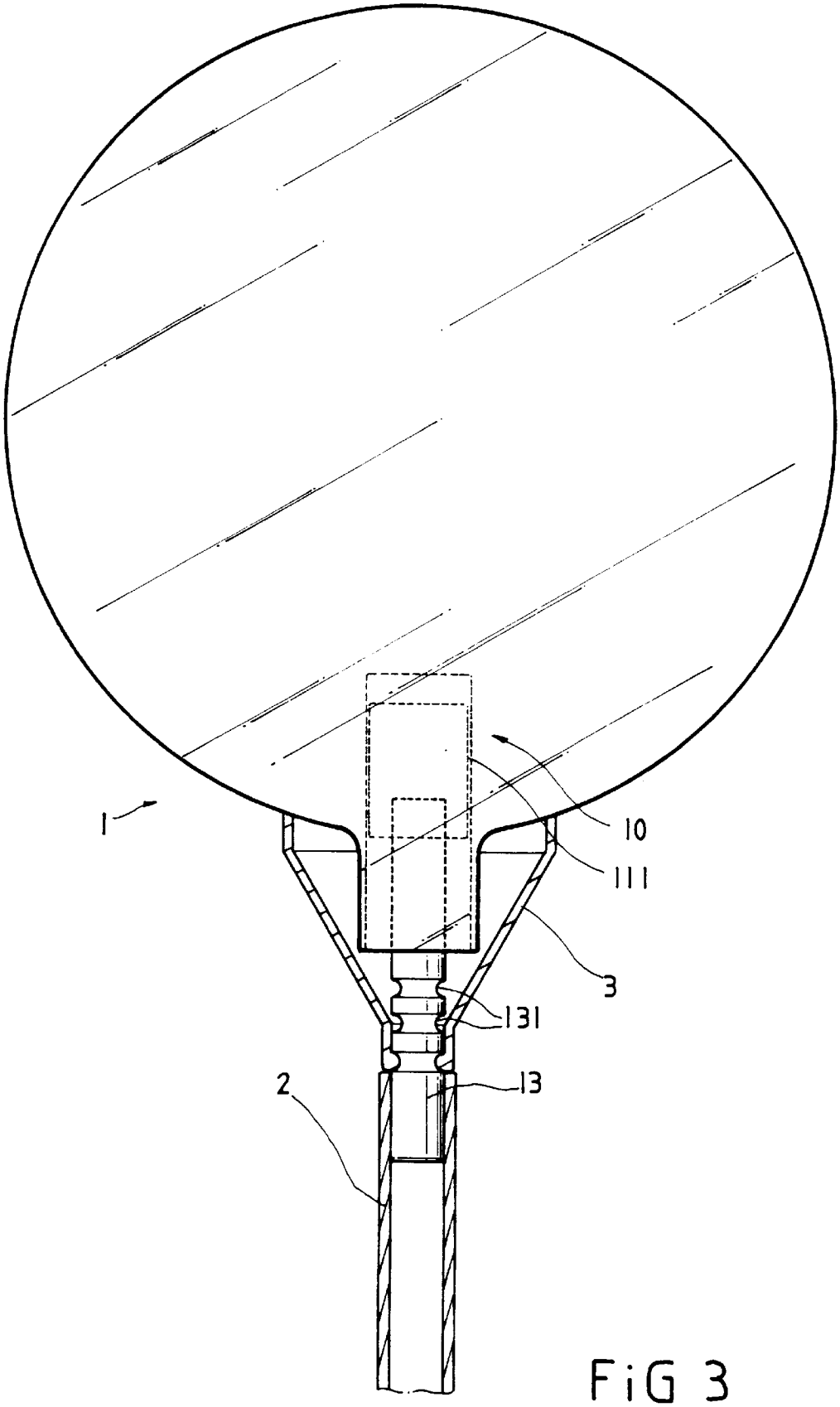
FIG. 3 is a sectional view of an alternate form of the inflatable bag according to the present invention.
Figure 4:
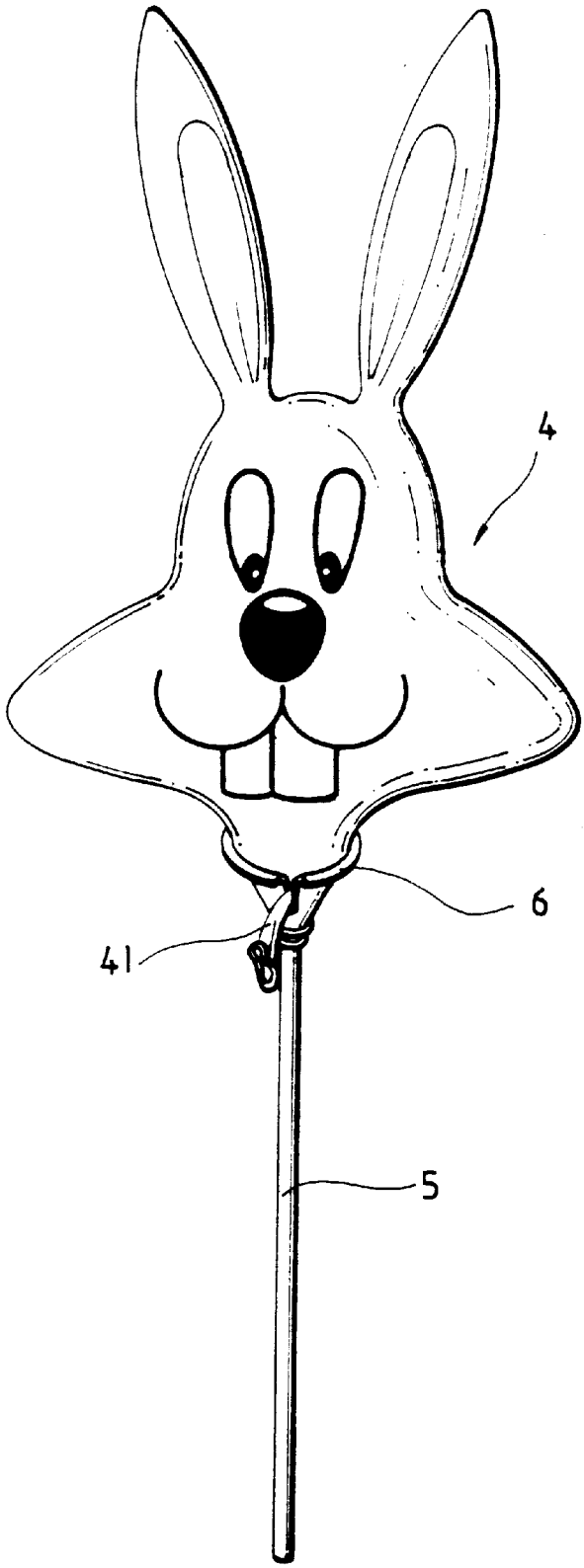
FiG 4 PRIOR ART
FIG. 4 illustrates an inflated inflatable bag fastened to a notch at a support member at one end of a stick according to the prior art.

FIG. 3 shows an alternate form of the present invention. According to this alternate form, a tubular stick 2 is fastened to the blow pipe 13 outside the air-tight bag body 1, and stopped at one end of the support member 3 against the outside wall of the air-tight bag body 1.

While only one embodiment of the present invention has been show and described, it will be understood that various modifications and changes could be made thereunto without departing from the spirit and scope of the invention disclosed.

What the invention claimed is:

1. An inflatable bag comprising:

a collapsible air-tight bag body;

a collapsible air inlet device sealed to said collapsible air-tight bag body through which forced air is driven into said air-tight bag body, said collapsible air inlet device being two rectangular flaps sealed together along their longitudinal edges to form a tubular structure having open ends and an inside wall area coated with a layer of ink for preventing portions forming the inside wall area from being sealed together and ensuring free air flow through the tube;

a blow pipe securely fastened to said collapsible air inlet device, said blow pipe having an inner end inserted into the ink-coated inside wall area of said air inlet device and an outer end extended out of said collapsible air-tight bag;

engagement means formed integrally with the periphery of said blow pipe outside of said collapsible air-tight bag body adjacent to said collapsible air inlet device;

a support member engaged with the engagement means and positioned for supporting the air-tight bag body on the blow pipe;

a tubular stick fastened to said blow pipe outside said collapsible air-tight bag body, the stick being secured at one end of said support member; and wherein said collapsible air inlet device is compressible by air pressure to close the ink-coated inside wall area of said collapsible air inlet device and to prevent air from escaping out of said collapsible air-tight bag body after said collapsible air-tight bag body has been inflated by air that has been forced through said blow pipe and said collapsible air inlet device into said collapsible air-tight bag body.

* * * * *